US009775209B2

(12) United States Patent
Grajcar et al.

(10) Patent No.: US 9,775,209 B2
(45) Date of Patent: Sep. 26, 2017

(54) HIGH FREQUENCY AC LED LIGHTING SYSTEM

(71) Applicant: Once, Inc., Plymouth, MN (US)

(72) Inventors: Zdenko Grajcar, Orono, MN (US); David Haskvitz, St. Michael, MN (US)

(73) Assignee: ONCE INNOVATIONS, INC., Plymouth, MN (US)

( * ) Notice: Subject to any disclaimer, the term of this patent is extended or adjusted under 35 U.S.C. 154(b) by 0 days.

(21) Appl. No.: 15/364,995

(22) Filed: Nov. 30, 2016

(65) Prior Publication Data

US 2017/0156186 A1 Jun. 1, 2017

Related U.S. Application Data

(60) Provisional application No. 62/261,589, filed on Dec. 1, 2015.

(51) Int. Cl.
*H05B 37/02* (2006.01)
*H05B 33/08* (2006.01)

(52) U.S. Cl.
CPC ..... *H05B 33/0845* (2013.01); *H05B 33/0818* (2013.01); *H05B 33/0833* (2013.01); *H05B 33/0842* (2013.01)

(58) Field of Classification Search
CPC ..... H05B 33/0833; H05B 33/0842; H05B 33/0845
USPC ..... 315/185 R, 186, 291, 294, 299
See application file for complete search history.

(56) References Cited

U.S. PATENT DOCUMENTS

| | | | | |
|---|---|---|---|---|
| 9,374,858 | B2 * | 6/2016 | Ni | H05B 33/0812 |
| 2016/0113079 | A1 * | 4/2016 | Hiramatu | H05B 33/0818 315/224 |
| 2017/0064781 | A1 * | 3/2017 | Haskvitz | H05B 33/083 |

* cited by examiner

*Primary Examiner* — Thuy Vinh Tran

(57) ABSTRACT

A circuit having a series interconnection of a light-emitting diode (LED) group, a first transistor, a second transistor and a first resistor. The series interconnection has a cathode coupled to a drain terminal of the first transistor and a source terminal of the first transistor is coupled to a first terminal of the first resistor wherein voltage across the first resistor to provide a biasing voltage for the first transistor. A source terminal of the second transistor is coupled to a first terminal of the first resistor wherein voltage across the second resistor provides a biasing voltage for the second transistor and ancillary circuitry bypasses the series interconnection. The ancillary circuitry has a capacitor to provide current to the series interconnection to increase the amount of light emitted during an electrical excitation cycle.

6 Claims, 12 Drawing Sheets

HIGH FREQUENCY AC LED LIGHTING SYSTEM

CROSS REFERENCE

This application is based upon and claims benefit to U.S. Provisional Patent Application Ser. No. 62/261,589 filed Dec. 1, 2015 entitled High Frequency AC LED Lighting System to Grajcar et al. and that application is incorporated by reference in full.

BACKGROUND

This invention relates to LED lighting circuits. More specifically this invention relates to a circuit for providing improved operation of an LED lighting device.

LED lighting is an energy efficient lighting source is becoming more and more popular world-wide. Several ways exist regarding how to successfully operate and dim LED devices. In particular, typically line voltage is AC or alternating current voltage where the voltage and current are represented by a sine wave. One circuit that can be used to operate and dim LED utilizes a rectifier and AC to DC converter in association with a PWM device to provide diming.

In an alternative embodiment applicant eliminated the AC to DC converter and need for a PWM device through conditioning the AC current directly provided to the LEDs. This is shown in applicant's U.S. Pat. No. 8,373,363 that is incorporated in full herein. While effective at operating and dimming, problems remain. During analog operation there are times during operation where current exists at zero cross for extended periods of time. For certain operations light is desired during this period. As one example, some flicker indexes put out by specification makers focus, not just on frequency of the AC sine wave, but also on the drop in current from peak to the valley of the sine wave.

Similarly, some flicker indexes require that AC LED operate at above 200 Hz as an acceptable frequency, regardless of waveform or shape, peak to valley measurements or the like. Thus a need exists in analog circuits to increase frequency to address flicker standards within the industry.

Therefore, a principle object of the present invention is to improve functionality of an AC analog circuit.

SUMMARY OF THE INVENTION

A circuit having a series interconnection of a light-emitting diode (LED) group, a first transistor, a second transistor and a first resistor. The series interconnection has a cathode coupled to a drain terminal of the first transistor and a source terminal of the first transistor is coupled to a first terminal of the first resistor wherein voltage across the first resistor provides a biasing voltage for the first transistor. A source terminal of the second transistor is coupled to a first terminal of the first resistor wherein voltage across the second resistor provides a biasing voltage for the second transistor. Ancillary circuitry bypasses the series interconnection and has a capacitor to provide current to the series interconnection to increase the amount of light emitted during an electrical excitation cycle.

DETAILED DESCRIPTION OF A PREFERRED EMBODIMENT

Figure 1:
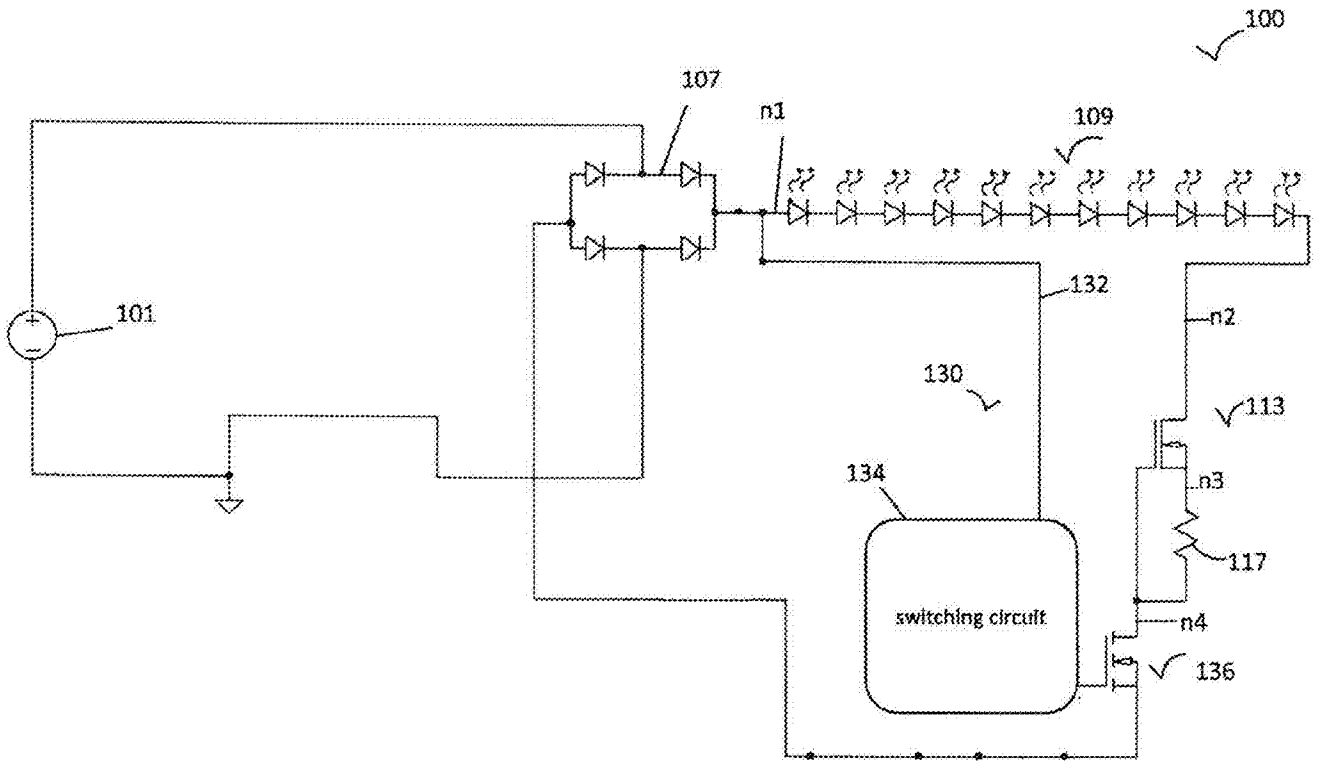
FIG. 1 is a schematic diagram of a circuit for an AC LED lighting device.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Driving circuitry for powering light emitting diode (LED) lights generally rely on digital circuitry to measure the instantaneous value of a driving voltage, on a microprocessor to identify LEDs to activate based on the measured value, and on digital switches to selectively activate the identified LEDs. The digital circuitry, however, reduces the overall efficiency of the LED lighting by causing harmonic distortion and power factor distortion in the LED light and the associated power line. In order to reduce the harmonic distortion and power factor distortion caused by the digital circuitry, a current conditioning circuit is presented for selectively routing current to various LED groups in a LED light. The current conditioning circuit uses analog components and circuitry for operation, and produces minimal harmonic distortion and power factor distortion.

The current conditioning circuitry is provided to selectively route current to different LED groups depending on the instantaneous value of an AC input voltage. In a preferred embodiment, the conditioning circuitry includes only analog circuit components and does not include digital components or digital switches for operation.

The circuitry relies on depletion-mode metal-oxide-semiconductor field-effect transistor (MOSFET) transistors for operation. In a preferred embodiment, the depletion MOSFET transistors have a high resistance between their drain and source terminals, and switch between conducting and non-conducting states relatively slowly. The depletion-mode MOSFET transistors may conduct current between their drain and source terminals when a voltage $V_{GS}$ between the gate and source terminals is zero or positive and the MOSFET transistor is operating in the saturation (or active, or conducting) mode (or region, or state). The current through the depletion-mode MOSFET transistor, however, may be restricted if a negative $V_{GS}$ voltage is applied to the terminals and the MOSFET transistor enters the cutoff (or non-conducting) mode (or region, or state).

The MOSFET transistor transitions between the saturation and cutoff modes by operating in the linear or ohmic mode or region, in which the amount of current flowing through the transistor (between the drain and source terminals) is dependent on the voltage between the gate and source terminals $V_{GS}$. In one example, the depletion MOSFET transistors preferably have an elevated resistance between drain and source (when operating in the linear mode) such that the transistors switch between the saturation and cutoff modes relatively slowly. The depletion MOSFET transistors switch between the saturation and cutoff modes by operating in the linear or ohmic region, thereby providing a smooth and gradual transition between the saturation and cutoff modes. In one example, a depletion-mode MOSFET transistor may have a threshold voltage of −2.6 volts, such that the depletion-mode MOSFET transistor allows substantially no current to pass between the drain and source terminals when the gate-source voltage $V_{GS}$ is below −2.6 volts. Other values of threshold voltages may alternatively be used.

FIG. 1 is a schematic diagram showing a single stage conditioning circuit 100 for driving one LED group using a rectified AC input voltage. The conditioning circuit 100 uses analog circuitry to selectively route current to the LED groups based on the instantaneous value of the AC input voltage. The conditioning circuit 100 receives an AC input voltage from an AC voltage source 101, such as a power supply, an AC line voltage, or the like. The AC voltage source 101 is coupled in parallel with two input terminals of a voltage rectifier 107. In one example, the voltage rectifier 107 can include a diode bridge rectifier that provides full-wave rectification of an input sinusoidal AC voltage waveform. In other examples, other types of voltage rectification circuitry can be used.

A series interconnection of a LED group 109, a first n-channel depletion MOSFET transistor 113 (coupled by the drain and source terminals), and a resistor 117 is coupled between the output terminals of the voltage rectifier 107. The LED group 109 has its anode coupled to the terminal (node n1), and its cathode coupled to the drain terminal of first depletion MOSFET transistor 113 (node n2). The source terminal of transistor 113 is coupled to a first terminal of resistor 117 (node n3), while both the gate terminal of transistor 113 and the second terminal of resistor 117 are coupled to the other terminal (node n4) of the voltage rectifier 107, such that the voltage across the first resistor 117 serves as the biasing voltage $V_{GS}$ between the gate and source terminals of the first transistor 113.

Inserted into circuit 100 is ancillary circuitry 130 in a pathway 132 in series to the rectifier 107 and bypassing the LED group 109. In the pathway 132 is a switching circuit 134 connected between the drain of a second transistor 136 and the rectifier 107. The switching circuit 134 can be of any type, including a combination of Zener diodes, a MOSFET or any other type of switch that is known in the art wherein based on the characteristics of the electricity flowing path 132, whether voltage controlled or current controlled actuates the switch to cause current to flow through the switch circuit 134. In addition the source terminal second transistor 136 is coupled to the rectifier 107.

Figure 2:
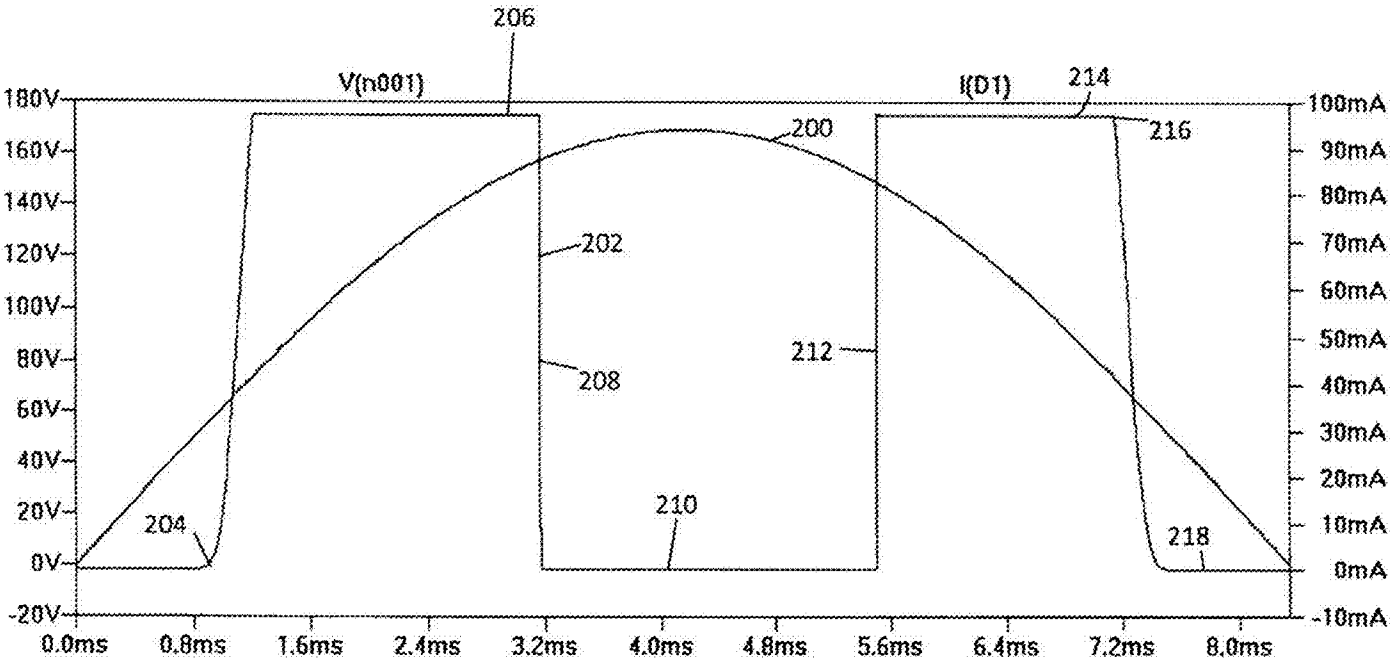
FIG. 2 is a graph showing circuit voltage and amps over time for the circuit of FIG. 1.

FIG. 2 shows the simulated voltage 200 and current 202 as a result of the topology. For a half cycle of the voltage the ripple or current 202, when a predetermined threshold voltage of the LED group 109 is reached at point 204 current begins to increase until a threshold current of the first transistor is reached as biased by the resistor 117 to provide a peak 206. Once a threshold voltage of the switching circuit 134 is reached current flows through the bypass path 132 to the second transistor 136 stopping the flow of current to the LED group 109 at point 208, forming valley 210 of no current flow. Once the voltage decreases under the threshold voltage of the switching circuit 134 at point 212 current again flows through the LED group 109 at a threshold current forming a second peak current 214 until the voltage reduces under the threshold voltage of the LED group 109 at point 216 causing another valley 218 where current does not flow restarting the cycle.

As a result of the topology two peaks 206 and 214 with a valley 210 are realized within a single half cycle of voltage. Thus when a full rectified wave is presented four peaks are present providing a 240 Hz current input for a 60 Hz AC input or 200 Hz current input for a 50 Hz AC input. In this manner the circuit increases the frequency of the input to comply with all standards.

While the above topology successfully increases frequency, improving upon the state of the art, additional problems can remain. In particular, regarding dimming, when a phase cut dimmer is utilized peaks 206 and 214 are greatly reduced or eliminated causing perceived flicker or darkness as a result of no current being present in valley 210. Thus a need in the art for a 200 Hz+ dimmable solution is desired.

Figure 3:
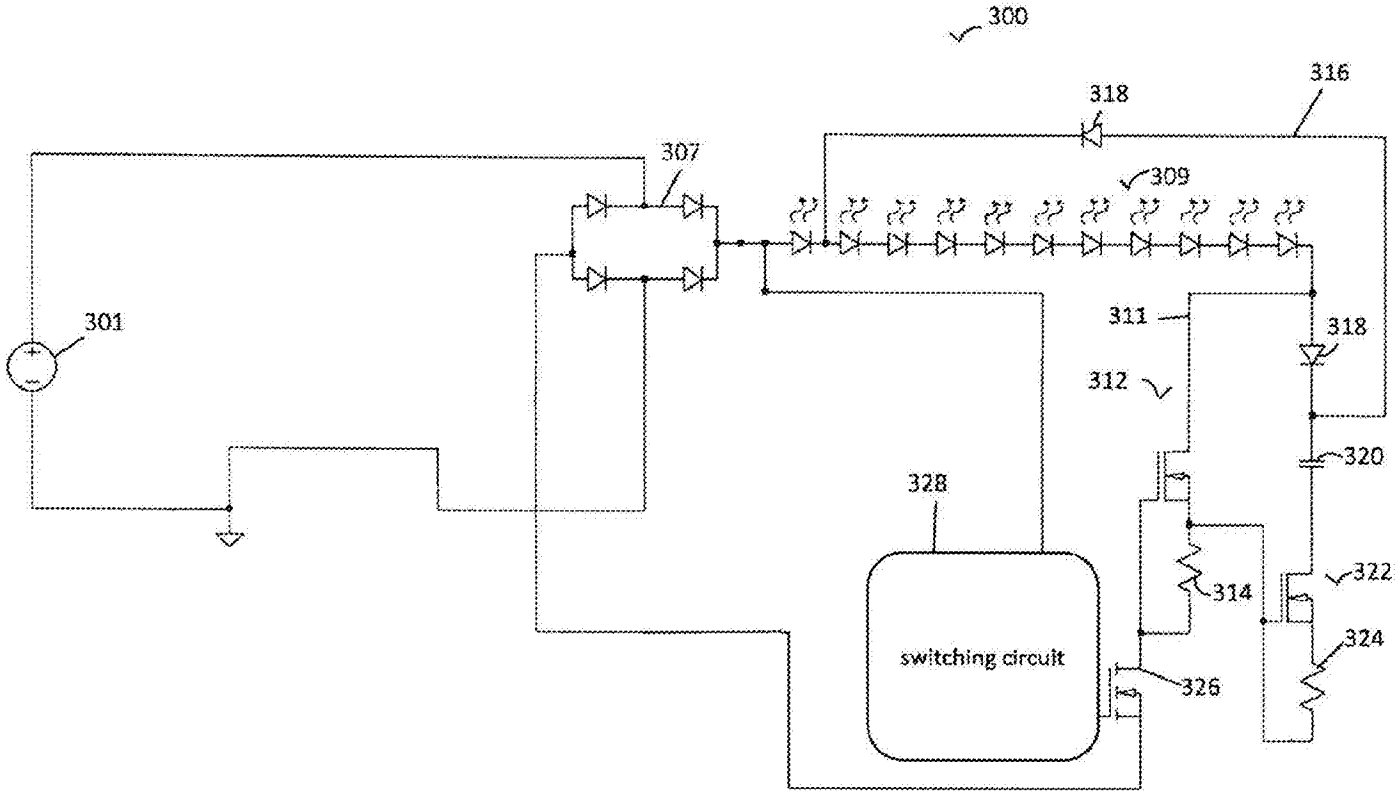
FIG. 3 is a schematic diagram of a circuit for an AC LED lighting device.
Figure 4:
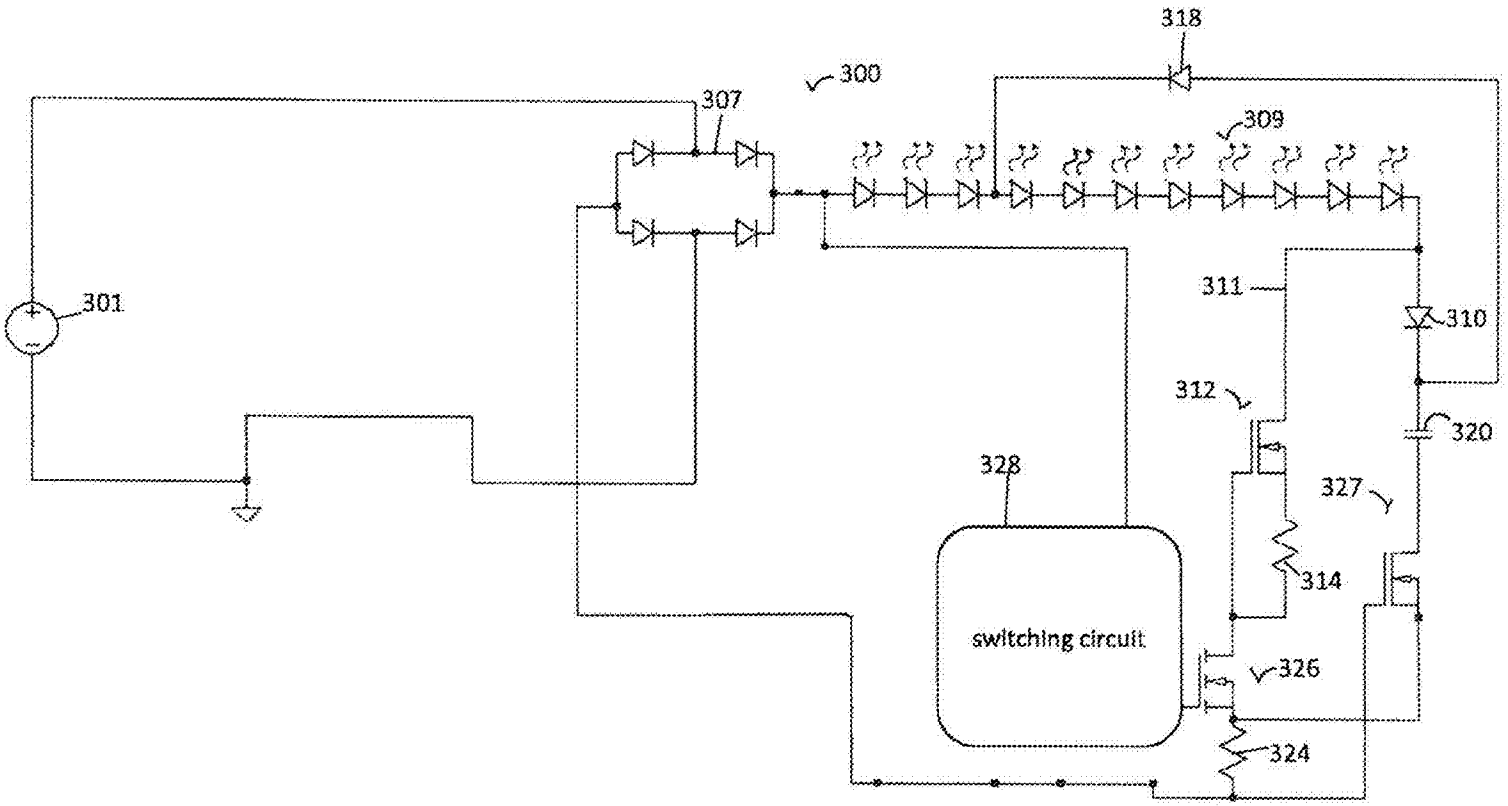
FIG. 4 is a schematic diagram of a circuit for an AC LED lighting device.

FIGS. 3 and 4 show solutions to this issue. In the embodiment of FIG. 3 a single stage conditioning circuit 300 for driving one LED group using a rectified AC input voltage. The conditioning circuit 300 uses analog circuitry to selectively route current to the LED groups based on the instantaneous value of the AC input voltage.

The conditioning circuit 300 receives an AC input voltage from an AC voltage source 301, such as a power supply, an AC line voltage, or the like. The AC voltage source 301 is coupled in parallel with two input terminals of a voltage rectifier 307. In one example, the voltage rectifier 307 can include a diode bridge rectifier that provides full-wave rectification of an input sinusoidal AC voltage waveform. In other examples, other types of voltage rectification circuitry can be used.

In series interconnection of a LED group 309, is a first regulating diode 310. A first bypass path 311 provides a series connection between the LED group 309 and a first transistor 312 (coupled by the drain and source terminals), and a resistor 314 is coupled between the output terminals of the voltage rectifier 307.

A second bypass path 316 after the first regulating diode 310 provides a series connection between the first regulating diode 310 and a second regulating diode 318 providing a series connection by both the first and second regulating diodes 310 and 318 to a capacitor 320. In series connection to the capacitor 320 is a second transistor 322 (coupled by the drain and source terminals), and a resistor 324 is coupled between the output terminals of the voltage rectifier 307. The gate of the second transistor 322 is connected to both resistor 324 and the source of the first transistor 312. A switching element 326 that in this embodiment is shown as a transistor is connected in series to the gate and source (through resistor 324) of the first transistor 312. In the embodiment of FIG. 4 resistor 324 is optionally connected to both in series to the source of the second transistor 322, but also in series with the source of a transistor being utilized as the switching element 326.

Figure 6:
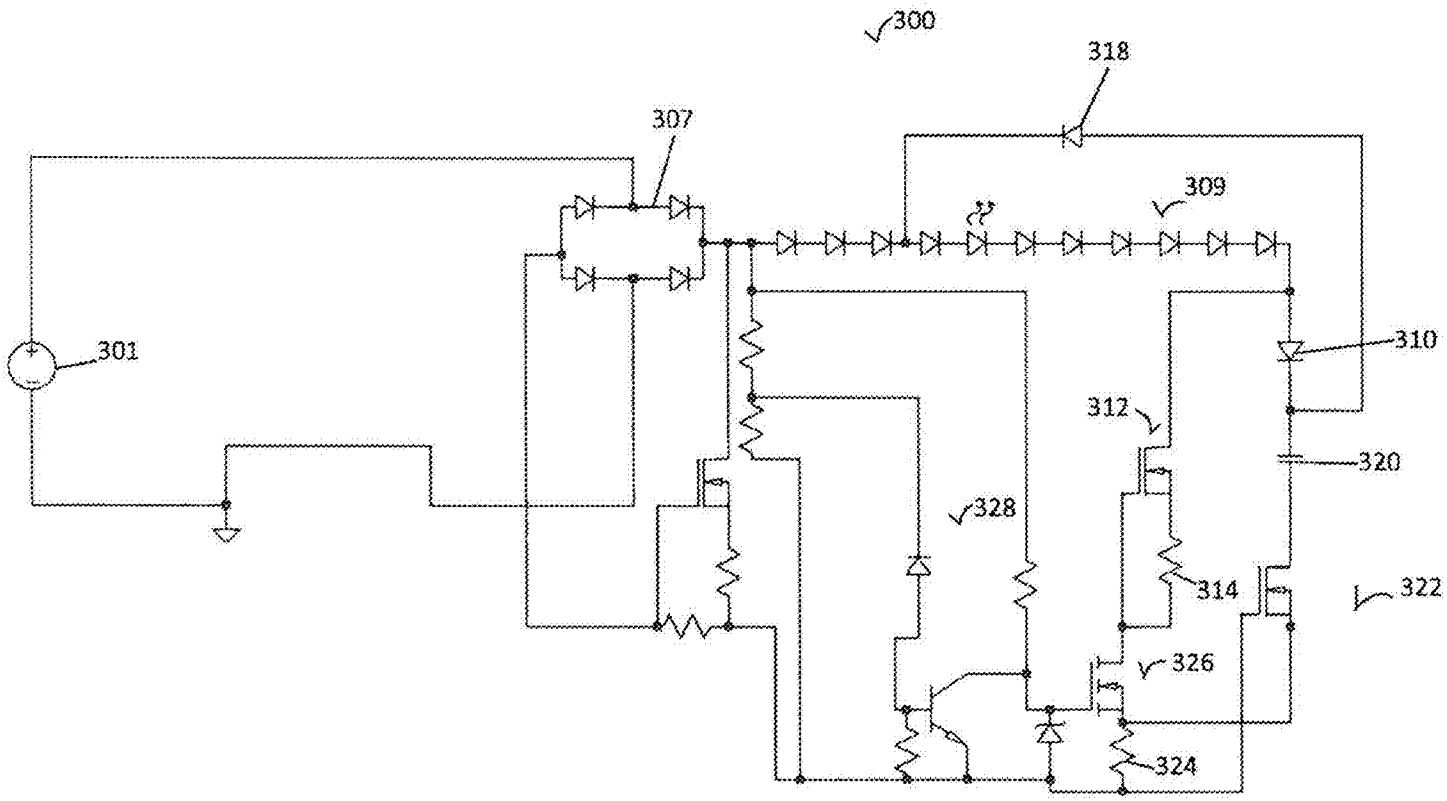
FIG. 6 is a schematic diagram of a circuit for an AC LED lighting device.

A switching circuit 328 is electrically connected to the switching element 326 preferably in series to the rectifier 307 to control the switching element 326. Any switching circuit 328 as is known in the art is utilized, including but not limited to a voltage control switching circuit 328 that turns the switching element 326 on and off to control current flow through the switching element. One example of the switching circuit is shown in FIG. 6. Thus, the switching circuit 328 controls current flow through the switching element 326 while the capacitor 320 provides a charge that can be discharged within the circuit 300.

Figure 5:
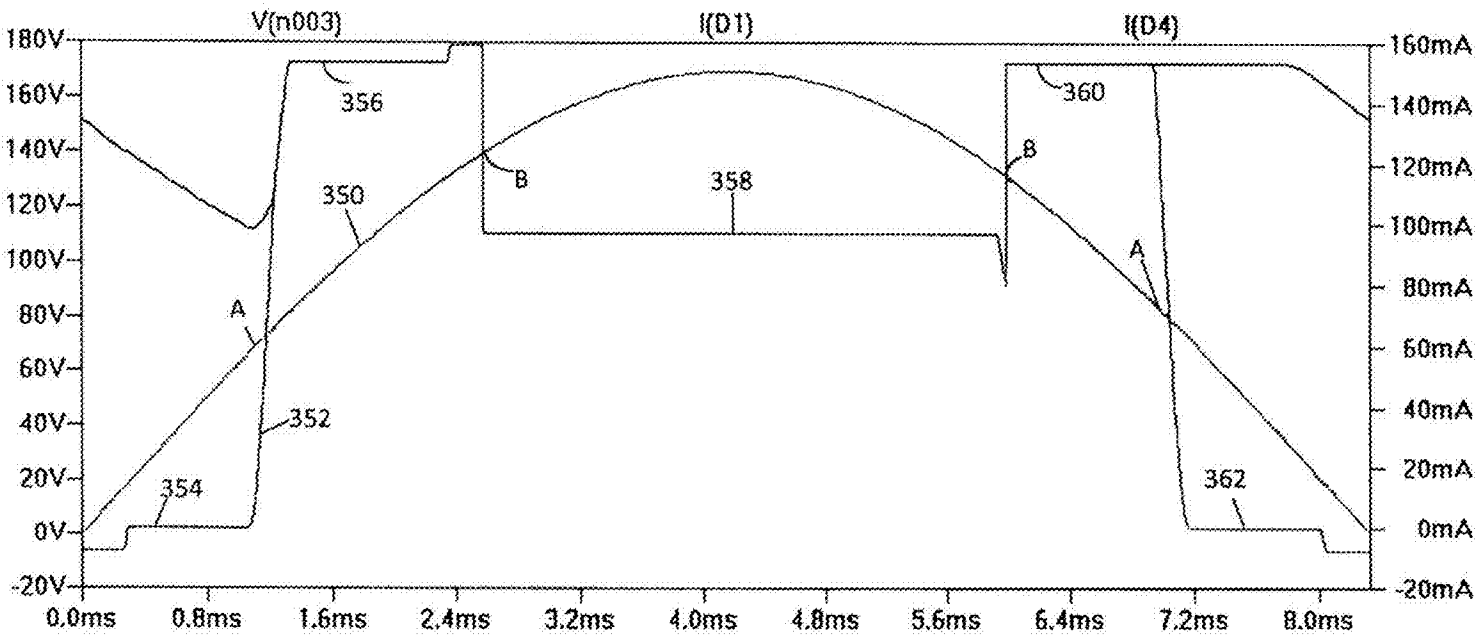
FIG. 5 is a graph showing circuit voltage and amps over time for the circuit of FIG. 4.

FIG. 5 shows the input voltage 350 and current 352 over time for a 60 Hz input for the circuit 300 of FIG. 4. As voltage 350 increases current stays in a first current valley 354 until and initial threshold voltage A of the LED group 309 is reached as which point the current flows through the LED group 309 to cause current to increase to a first peak current 356. Once a secondary threshold voltage B is reached the switching circuit 328 switches or turns the switching element 326 off to prevent the flow of current through the switching element 326 causing the current to drop. The capacitor 320 then discharges to provide a constant current input or valley 358 that extends until the secondary threshold voltage is again reached causing the switching circuit 328 to turn on or allow current flow through the switching element 326 thus increasing the current to a second peak current 360. As voltage continues to decrease the threshold voltage A of the LED 309 is again reached causing current to no longer flow through the LED group 309 causing a current drop to a second current valley 362. When rectified as in the circuit 300 this process then repeats over the next period.

As a result of the current drop at the secondary threshold voltage B, first and second current peaks 356 and 360 are presented during a single 60 Hz input voltage, resulting in a 120 Hz output for an unrectified input and a 240 Hz output for a rectified input. For a 50 Hz input voltage, a 100 Hz output for an unrectified input and a 200 Hz output for a rectified input are presented. Meanwhile, the capacitor ensures current flow remains at the current valley 362.

Figure 7:
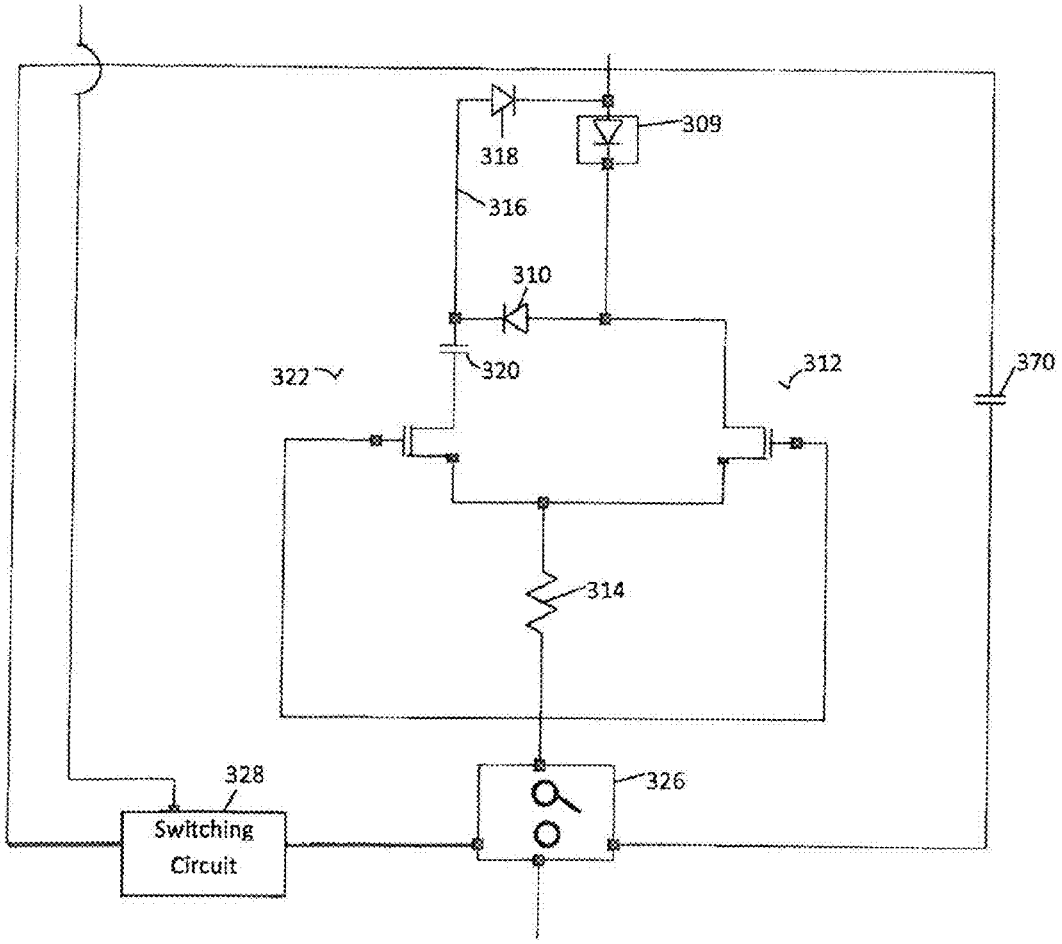
FIG. 7 is a schematic diagram of a circuit for an AC LED lighting device.

FIGS. 7-12 and additional figures show many different embodiments of the circuit 300 and resulting waveforms that utilize current conditioning circuitry. FIG. 7 as an example shows in series interconnection of a LED group 309, is a first regulating diode 310. A first bypass path 311 provides a series connection between the LED group 309 and a first transistor 312 (coupled by the drain and source terminals), and a resistor 314.

A second bypass path 316 after the first regulating diode 310 provides a series connection between the first regulating diode 310 and a second regulating diode 318. A first capacitor 320 is connected in series to the cathode of the first regulating diode 310 and the anode of the second regulating diode 318 to provide current that can flow through the second regulating diode 318.

In series connection to the capacitor 320 is a second transistor 322 (coupled by the drain and source terminals), and the resistor 314 is coupled to the second transistor 322. The gate of the second transistor 322 is connected to both resistor 314 and the source of the first transistor 312. A switching element 326 is connected in series to the gate and source (through resistor 314) of the first transistor 312.

A switching circuit 328 is electrically connected to the switching element 326 preferably in series to the rectifier 307 to control the switching element 326. Any switching circuit 328 as is known in the art is utilized, including but not limited to a voltage control switching circuit 328 that toggles the switching element 326 between a first position and a second position to direct current flow through the switching element. Thus, the switching circuit 328 controls current flow through the switching element 326.

Figure 8:
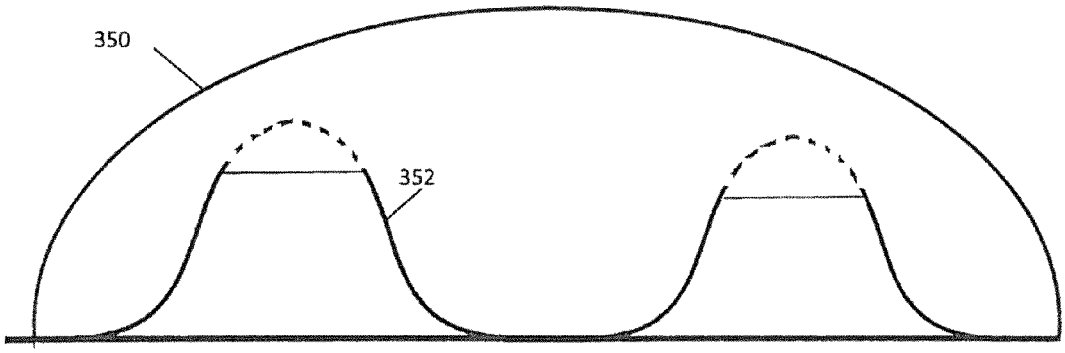
FIG. 8 is a graph showing circuit voltage and amps over time for the circuit of FIG. 7.
Figure 9:
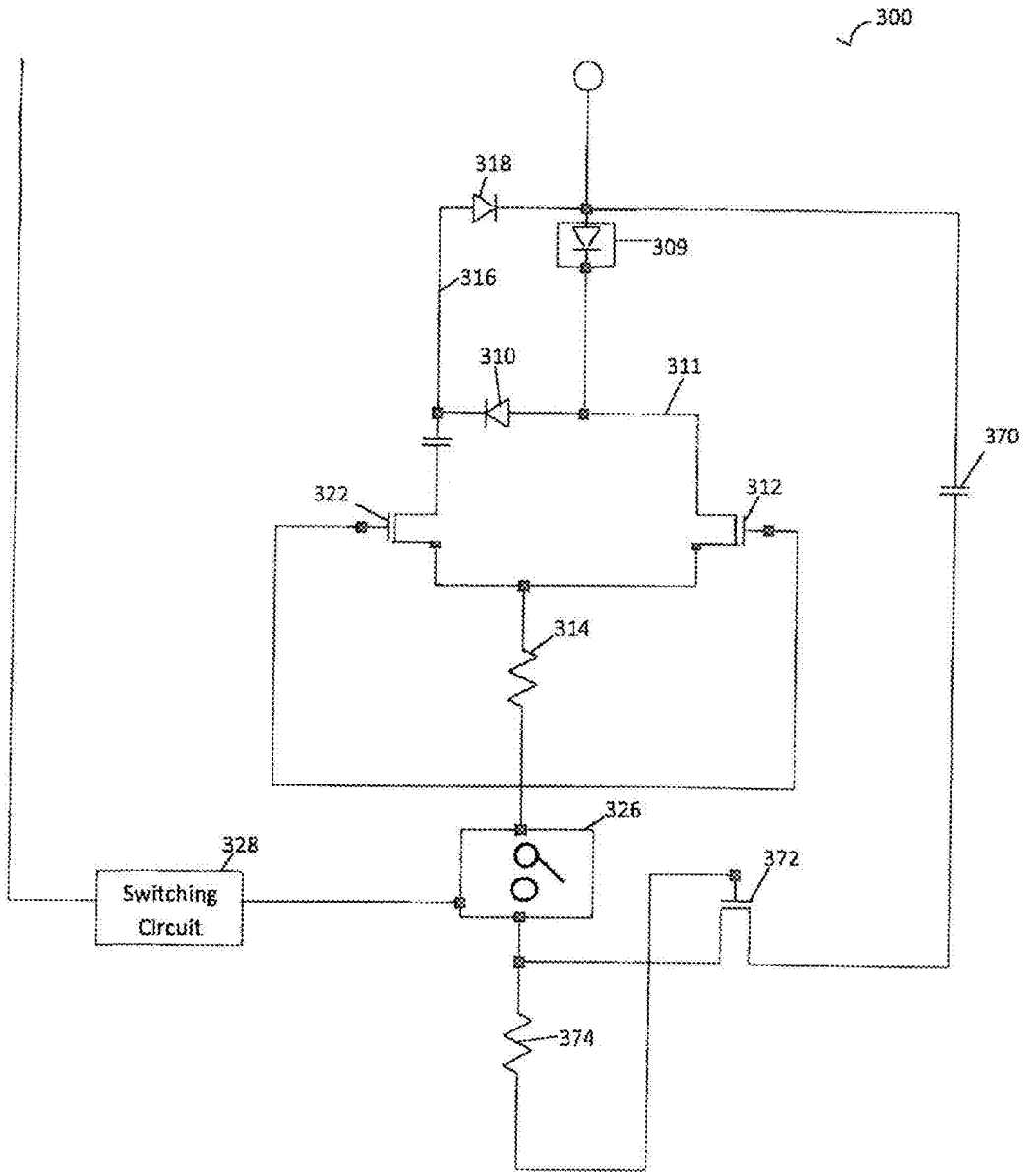
FIG. 9 is a schematic diagram of a circuit for an AC LED lighting device.
Figure 10:
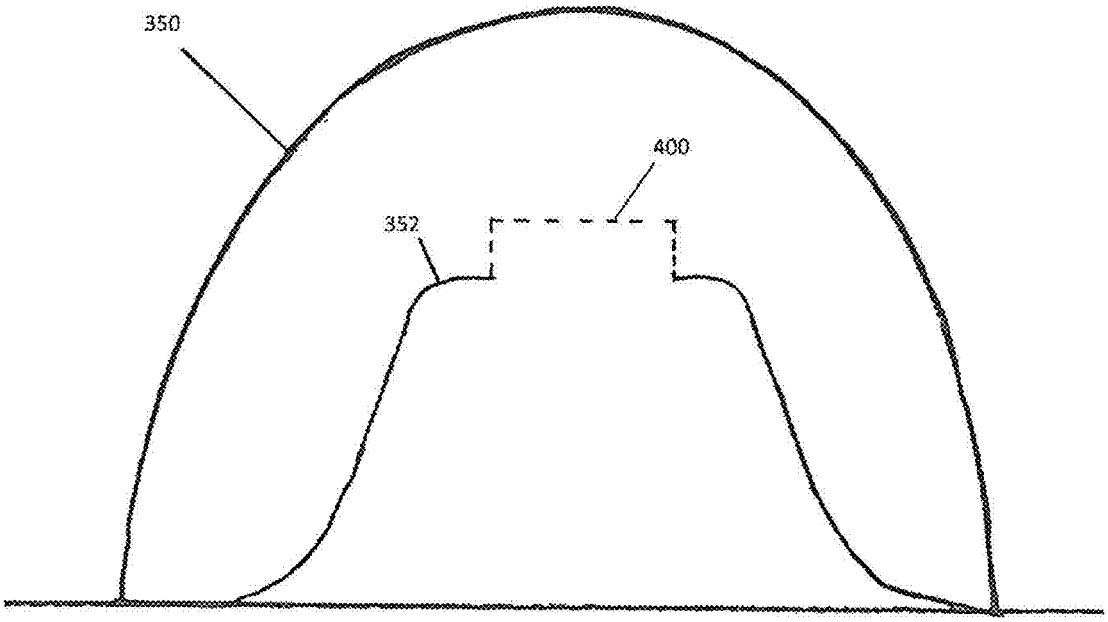
FIG. 10 is a graph showing circuit voltage and amps over time for the circuit of FIG. 9.

In the embodiment of FIG. 7 a second capacitor 370 is in series with the switching element 326. In this manner when the switching element 326 is in the first position the first capacitor 320 discharges and when in a second position the second capacitor 370 discharges such that current continues to flow through the circuit as needed to provide current to the LED group 309 and regulating diodes 310 and 318. The resulting waveform is shown in FIG. 8. Specifically FIG. 9 shows a similar embodiment to FIG. 7 and adds an ancillary transistor 372 with a drain in series connection with the second capacitor 370 and a gate and source in series connection with an ancillary resistor 374 that is in series connection with the switching element 326. In this manner an additional step 400 is provided in the current waveform 352 where a peak is provided as the voltage 350 increases to a maximum voltage as shown in FIG. 10.

Figure 11:
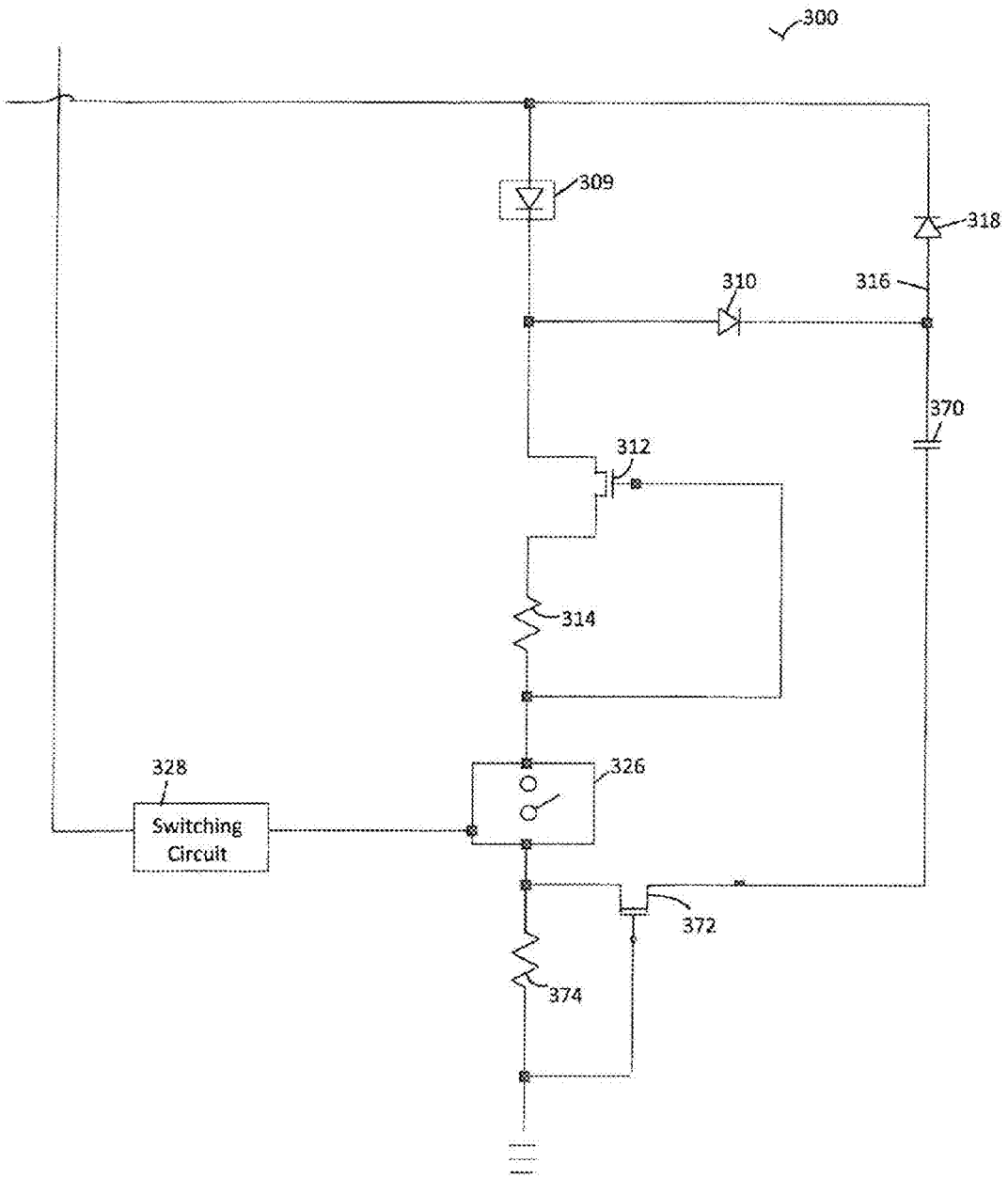
FIG. 11 is a schematic diagram of a circuit for an AC LED lighting device.
Figure 12:
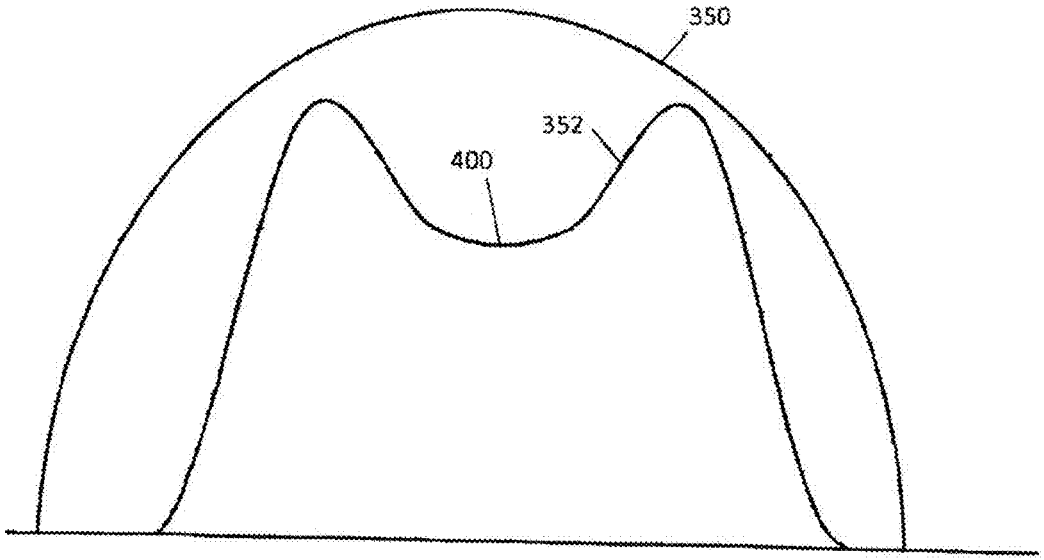
FIG. 12 is a graph showing circuit voltage and amps over time for the circuit of FIG. 11.

FIG. 11 shows yet another variation of the embodiments of FIGS. 7 and 9 where the second capacitor 370 and ancillary transistor 372 and ancillary resistor 374 are provided identical to the circuit of FIG. 9 in relation to the first transistor 312, first resistor 314 and switching element 326 to provide an additional step as shown in FIG. 12. However, in this embodiment the first capacitor 320 and first transistor 312 are eliminated leaving only the second capacitor 370 that discharges to provide additional current through the circuit 300, thus resulting in the waveform of FIG. 12. Specifically, instead of the step 400 providing a peak as voltage 350 increases to a maximum voltage, the current is reduced at step 400 to provide a valley between two peaks, thus reducing the drop in current from a maximum current level to a minimum current level as compared to the circuit of FIG. 9. Thus, two peaks of maximum current are provided increasing frequency of the circuit.

In the embodiments of FIGS. 7-12 current peaks are presented in combination with current drops as a result of input to the switching element 326 to provide additional frequency cycles, thus increasing the output frequency of the circuit 300. The capacitor(s) 320 and 370 then discharge to fill the valley(s) created by the switching element 326 to insure current is presented throughout the cycle. Thus, not only is frequency increased to 200 Hz or 240 Hz depending on input, but current stays constant insuring minimal effects to total harmonic distortion (THD) and power factor and increasing duty cycle. In addition the circuitry can be fully dimmable, accommodate multiple stages and allow for choice of LEDs to allow for color changing during the dimming process as taught by U.S. Pat. No. 8,643,308 to Grajcar that is incorporated in full herein.

The conditioning circuits shown and described in this application, and shown in the figures, and the various modifications to conditioning circuits described in the application, are configured to drive LED lighting circuits with reduced or minimal total harmonic distortion. By using analog circuitry which gradually and selectively routes current to various LED groups, the conditioning circuits provide a high lighting efficiency by driving one, two, or more LED groups based on the instantaneous value of the driving voltage. Furthermore, by using depletion MOSFET transistors with elevated drain-source resistances $r_{ds}$, the depletion MOSFET transistors transition between the saturation and cutoff modes relatively slowly. As such, by ensuring that the transistors gradually switch between conducting and non-conducting states, the switching on and off of the LED groups and transistors follows substantially sinusoidal contours. As a result, the circuitry produces little harmonic distortion as the LED groups are gradually activated and deactivated. In addition, the first and second (or more) LED groups control current through each other: the forward voltage level of the second LED group influences the current flow through the first LED group, and the forward voltage level of the first LED group influences the current flow through the second LED group. As a result, the circuitry is self-controlling through the interactions between the multiple LED groups and multiple MOSFET transistors.

In one aspect, the term "field effect transistor (FET)" may refer to any of a variety of multi-terminal transistors generally operating on the principals of controlling an electric field to control the shape and hence the conductivity of a channel of one type of charge carrier in a semiconductor material, including, but not limited to a metal oxide semiconductor field effect transistor (MOSFET), a junction FET (JFET), a metal semiconductor FET (MESFET), a high electron mobility transistor (HEMT), a modulation doped FET (MODFET), an insulated gate bipolar transistor (IGBT), a fast reverse epitaxial diode FET (FREDFET), and an ion-sensitive FET (ISFET).

In one aspect, the terms "base," "emitter," and "collector" may refer to three terminals of a transistor and may refer to a base, an emitter and a collector of a bipolar junction transistor or may refer to a gate, a source, and a drain of a field effect transistor, respectively, and vice versa. In another aspect, the terms "gate," "source," and "drain" may refer to "base," "emitter," and "collector" of a transistor, respectively, and vice versa.

Unless otherwise mentioned, various configurations described in the present disclosure may be implemented on a Silicon, Silicon-Germanium (SiGe), Gallium Arsenide (GaAs), Indium Phosphide (InP) or Indium Gallium Phosphide (InGaP) substrate, or any other suitable substrate.

A reference to an element in the singular is not intended to mean "one and only one" unless specifically so stated, but rather "one or more." For example, a resistor may refer to one or more resistors, a voltage may refer to one or more voltages, a current may refer to one or more currents, and a signal may refer to differential voltage signals.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

A phrase such as an "example" or an "aspect" does not imply that such example or aspect is essential to the subject technology or that such aspect applies to all configurations of the subject technology. A disclosure relating to an example or an aspect may apply to all configurations, or one or more configurations. An aspect may provide one or more examples. A phrase such as an aspect may refer to one or more aspects and vice versa.

A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such as an embodiment may refer to one or more embodiments and vice versa. A phrase such as a "configuration" does not imply that such configuration is essential to the subject technology or that such configuration applies to all configurations of the subject technology.

A disclosure relating to a configuration may apply to all configurations, or one or more configurations. A configuration may provide one or more examples. A phrase such a configuration may refer to one or more configurations and vice versa.

In one aspect of the disclosure, when actions or functions are described as being performed by an item (e.g., routing, lighting, emitting, driving, flowing, generating, activating, turning on or off, selecting, controlling, transmitting, sending, or any other action or function), it is understood that such actions or functions may be performed by the item directly or indirectly. In one aspect, when a module is described as performing an action, the module may be understood to perform the action directly. In one aspect, when a module is described as performing an action, the module may be understood to perform the action indirectly, for example, by facilitating, enabling or causing such an action.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain. In one aspect, the term "coupled", "connected", "interconnected", or the like may refer to being directly coupled, connected, or interconnected (e.g., directly electrically coupled, connected, or interconnected). In another aspect, the term "coupled", "connected", "interconnected", or the like may refer to being indirectly coupled, connected, or interconnected (e.g., indirectly electrically coupled, connected, or interconnected).

The disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed:

1. A circuit comprising:

a series interconnection of a light-emitting diode (LED) group, a first transistor, a second transistor and a first resistor, wherein:

the series interconnection has a cathode coupled to a drain terminal of the first transistor and a source terminal of the first transistor is coupled to a first terminal of the first resistor wherein voltage across the first resistor provides a biasing voltage for the first transistor;

a source terminal of the second transistor is coupled to the first terminal of the first resistor wherein voltage across a second resistor provides a biasing voltage for the second transistor; and ancillary circuitry bypassing the series interconnection and having a capacitor to provide current to the series interconnection to increase the amount of light emitted during an electrical excitation cycle.

2. The circuit according to claim 1, wherein the capacitor is connected between the drain of an ancillary transistor and a rectifier wherein the ancillary transistor is coupled to a first terminal of an ancillary resistor to provide a biasing voltage for the ancillary transistor.

3. The circuit according to claim 1, wherein the first and second transistors are depletion MOSFET transistors.

4. The circuit according to claim 1 further comprising a dimmer electrically connected to the series interconnection.

5. The circuit of claim 4 wherein the dimmer is a phase cut dimmer.

6. The circuit of claim 4 wherein the dimmer is configured to provide a relative light output of 5%.

* * * * *